United States Patent [19]

Finn et al.

[11] 3,991,538

[45] Nov. 16, 1976

[54] PACKAGING APPARATUS FOR COMPRESSIBLE STRIPS

[75] Inventors: Lawrence R. Finn, Toledo; Richard C. Yawberg, Grand Rapids, both of Ohio

[73] Assignee: Owens-Corning Fiberglas Corporation, Toledo, Ohio

[22] Filed: Jan. 27, 1975

[21] Appl. No.: 544,426

[52] U.S. Cl. ..... 53/21 FW; 53/24; 53/118; 53/124 D; 242/55.1; 242/DIG. 3

[51] Int. Cl.[2] ..... B65B 63/02; B65B 63/04

[58] Field of Search..... 53/21 FW, 24, 118, 124 C, 53/124 D; 242/55, 55.1, DIG. 3

[56] References Cited

UNITED STATES PATENTS

| | | | |
|---|---|---|---|
| 2,681,702 | 6/1954 | Kuenn et al. | 53/118 X |
| 2,881,984 | 4/1959 | Dyken | 242/DIG. 3 |
| 3,911,641 | 10/1975 | Miller et al. | 53/118 X |

FOREIGN PATENTS OR APPLICATIONS

| | | | |
|---|---|---|---|
| 1,372,595 | 8/1964 | France | 53/118 |
| 1,239,979 | 3/1967 | Germany | 53/118 |

*Primary Examiner*—Travis S. McGehee
*Attorney, Agent, or Firm*—John W. Overman; Allen D. Gutchess, Jr.

[57] ABSTRACT

Apparatus is provided for packaging strips of flexible, compressible material, such as layers of glass fibers. The compressible strip is wound under compression into a roll by the apparatus to provide a compact package. The compressed package can then be held in that state by tapes or the like which are automatically fed into contact with a trailing end portion of the compressible strip as it is being rolled up. The packaging apparatus includes a generally horizontal conveyor which carries the strip along a generally horizontal path. An upright, back-up belt conveyor is positioned to intercept the strip in its path and to deflect the forward edge of the strip upwardly away from the path. An infeed or guide roll helps to guide the forward edge of the strip toward the upright conveyor and a compression or tuck roll helps to turn the forward edge back downwardly after it is directed upwardly by the belt conveyor and to cause the strip to begin to roll into a spiral package. One side of the package then is contacted by an upwardly moving run of the conveyor belt and the other side of the package is contacted by the tuck roll which is driven in a manner to move the package in a direction opposite to the back-up conveyor. The tuck roll is also urged toward the backup conveyor so as to maintain compression on the strip as it is being rolled into the package. As the package is being completed, tape is dispensed on the horizontal conveyor and carried into contact with the trailing end of the strip and the outer wrap of the package so as to hold the strip in its packaged condition. At this time, the back-up conveyor is swung away from the horizontal conveyor and away from the path of the strip with the strip package then being ejected beyond the back-up conveyor where it can be transferred to a shipping point or processing station, by way of example. The packaging apparatus is also equipped with adjustments which enable it to accommodate strips of fibrous material of widely varying thicknesses.

25 Claims, 14 Drawing Figures

PACKAGING APPARATUS FOR COMPRESSIBLE STRIPS

This invention relates to apparatus for packaging a strip of fibrous material into a compressed package.

Heretofore, strips of compressible fibrous material have been removed from a line on which they are formed and packaged by workmen who handle the individual rolls. This packaging has been relatively slow and required considerable amount of labor and handling. Further, the packaged strips have not always been as neat or compressed to the desired extent.

The present invention provides apparatus for packaging strips of fibrous material automatically directly from a production line on which the strips are produced. Each strip is rolled on itself under compression and, when finished, is taped automatically to provide a completed rolled package which is then automatically ejected from the apparatus. The strip is not handled at all until in the complete, packaged form to provide a substantial savings in labor, and the effort required by the workmen is less than heretofore needed in packaging such material. The package also frequently is compressed to an extent greater than that heretofore achieved.

More specifically, the packaging apparatus according to the invention has a generally horizontally-extending conveyor which moves the compressible strip of fibrous material longitudinally in a generally horizontal path. The fibrous layer typically comprises glass fibers held together by a binder and commonly having a backing sheet which is adhered to the fibrous layer on the production line. The overall strip can be up to eight feet or more wide and have a thickness from as little as 1½ inches to about 14 inches. Obviously, a roll of such material can be quite bulky if not compressed substantially when packaged.

The apparatus also includes an upright or back-up belt conveyor positioned in the path of the strip moved by the horizontal conveyor and preferably near the discharge end thereof. The upright conveyor has a first or forward run of the belt which is moved upwardly so that the forward edge of the strip is deflected upwardly when it contacts the forward run of the belt. The back-up conveyor preferably has a lower end extending below the path of the horizontal conveyor and is pivoted so as to be moved to a remote position to enable the completed package to be discharged.

In front of the back-up conveyor is an infeed or guide roll which engages the upper surface of the fibrous strip and presses it downwardly and below a compression or tuck roll. These rolls are driven in opposite directions. The surface of the tuck roll closest to the forward run of the back-up belt moves in a downward direction, opposite to the movement of the forward run of the belt. With this arrangement, the tuck roll engages the forward edge of the strip as it is moved up by the belt and doubles it back on itself so as to move downwardly and thereby cause the strip to begin to roll into the desired, spiral package. The two rolls are mounted on a frame which is urged toward the back-up conveyor so as to apply compressive forces on the fibrous strip as it is wound. Preferably, the force urging the rolls toward the back-up conveyor increases somewhat as the size of the package increases to increase the compression on the wraps of the strip as it is wound. The frame for the two rolls preferably is pivoted and counter-weighted with the pivot shaft for the frame being vertically adjustable to accommodate different thicknesses of the fibrous strip being packaged. The frame also is angularly adjustable to maintain the two rolls in a given position relative to the back-up conveyor. The rolls are also adjustable relative to one another so that various types of fibrous strips can be handled and packaged.

Tape dispensers dispense lengths of tapes onto the horizontal conveyor under the trailing end of the compressible strip with these tapes being carried on the trailing end of the strip and adhered to the outer wrap, so as to maintain the packaged strip in the packaged, compressed state. The back-up conveyor is then swung out of the way and the package discharged from the end of the horizontal conveyor.

The main conveyor can have a plurality of rows of holes or perforations therealong which are aligned with the tapes being dispensed so as to hold the tapes in position on the conveyor belt. The same conveyor can have a pressure chamber between the negative zones to provide a cushion of air between the belt and its support and reduce the friction of the belt on a skid plate of the conveyor. The back-up conveyor belt can also have positive pressure therebehind to reduce the friction between it and its skid plate.

It is, therefore, a principal object of the invention to provide improved apparatus for packaging a strip of fibrous material.

Another object of the invention is to provide apparatus for packaging a strip of fibrous material into a roll under greater compression than heretofore.

A further object of the invention is to provide apparatus for packaging a compressible strip into a roll and applying tapes to the outer wraps thereof.

Yet another object of the invention is to provide apparatus including a back-up conveyor and a tuck roll for forming a forward end of a compressible strip into a core of a package.

Still another object of the invention is to provide apparatus for packaging a compressible strip which can be of various thicknesses, widths, and lengths.

Yet a further object of the invention is to provide strip packaging apparatus which includes a back-up conveyor and a tuck roll which is urged toward the back-up roll to maintain compression on the strip and to increase the compressive force as the size of the package increases.

Still a further object of the invention is to provide apparatus for packaging a fibrous strip which includes a back-up conveyor, a tuck roll, and a guide roll for guiding a forward edge of the strip under the tuck roll and toward the back-up conveyor.

Many other objects and advantages of the invention will be apparent from the following detailed description of a preferred embodiment thereof, reference being made to the accompanying drawings, in which.

Figure 1:
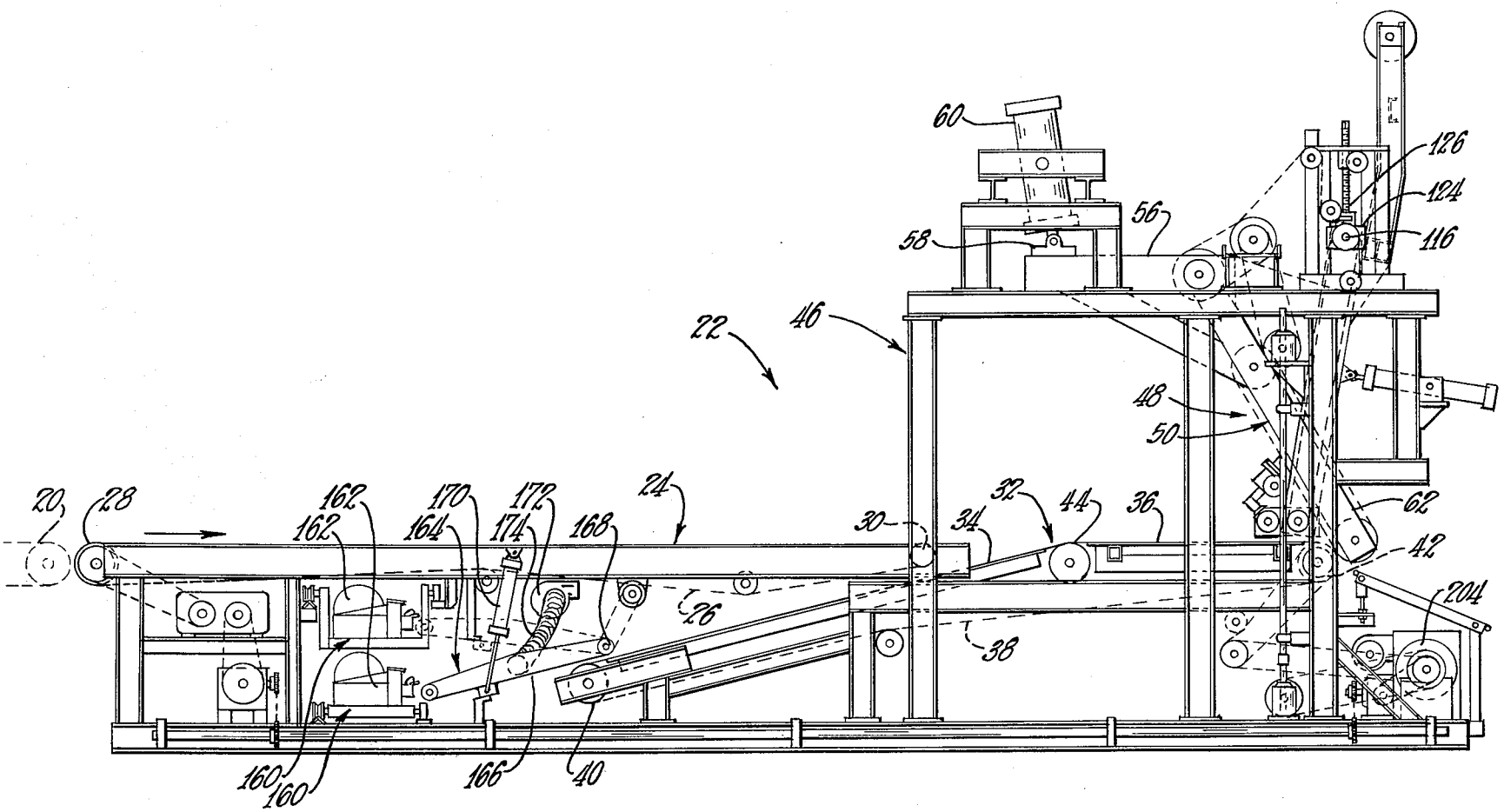
FIG. 1 is a somewhat schematic side view in elevation of packaging apparatus embodying the invention.

The packaging apparatus of FIG. 1 can package a fibrous strip formed directly on a production line upstream thereof. Typically, this firbrous strip consists of a layer of glass fibers held together by a binder and adhered to a backing sheet. The binder is uncured in this instance, with the strip, after being packaged and transported to another location, then being further processed. For example, the material can be used to produce molded pipe insulation or molded ceiling tiles in molds through which hot gases are passed to cure the binder while the fibrous material is maintained in the desired shapes by the molds. The thickness of the fibrous layer can vary widely, as little as 1 ½ inches or as much as 14 inches. The width and length of the layer or strip also can be subject to wide variations, the strip typically having a width from 39 to 88 inches and a length from 35 to 200 feet.

The fibrous strip can be made on the production line in a known manner. Accordingly, the glass fibers are attenuated from streams of heat-softened glass emitted from a rotary spinner with the attenuated fibers being directed downwardly by hot gaseous blasts through a forming hood where they are sprayed with binder. The fibers are then received on a suitable conveyor in a layer of a desired thickness. subsequently, a coated kraft paper or similar backing sheet is applied to the fibrous layer, being fed upwardly and underneath the layer. The compressible strip in the form of the fibrous layer and backing sheet is then carried along a discharge conveyor indicated at 20 where it is cut to a desired length by a cut-off knife and discharged in fixed lengths from the conveyor 20.

The fibrous strips are then received by packaging apparatus 22 according to the invention, being first placed on a transfer conveyor 24 having a suitable belt 26 extending around a head pulley 28 and tail pulley 30. The fibrous strips are then moved onto a supply or feed conveyor 32 having an inclined portion 34 and a generally horizontally-extending portion 36. The supply conveyor 32 includes a belt 38 extending around a head pulley 40, a tail pulley 42, and an intermediate pulley 44. Certain other details of the supply conveyor 32 will be discussed subsequently.

If desired, the entire packaging apparatus 22 beyond the conveyor 20 can be mounted on wheels located on tracks positioned transversely to the conveyor 20. With this arrangement, the entire apparatus can be moved to one side of the production line when it is not needed or wanted.

Figure 2:
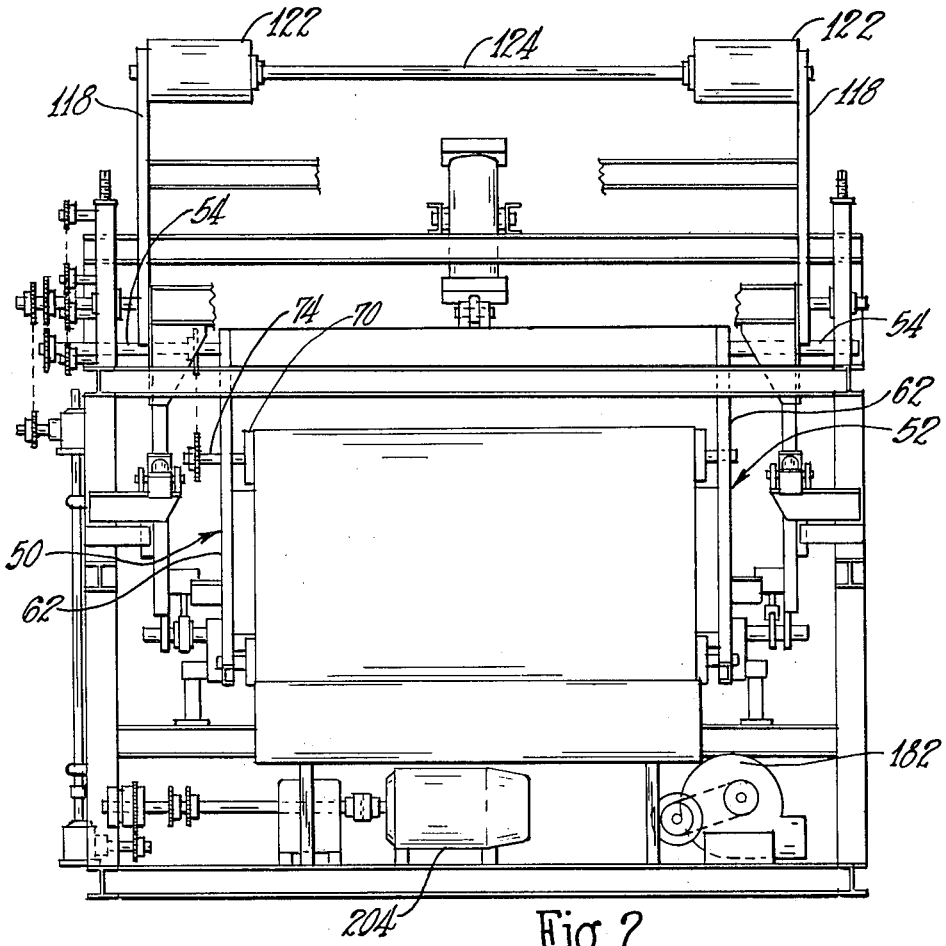
FIG. 2 is a somewhat schematic discharge end view in elevation, with parts broken away, of the packaging apparatus of FIG. 1.
Figure 4:
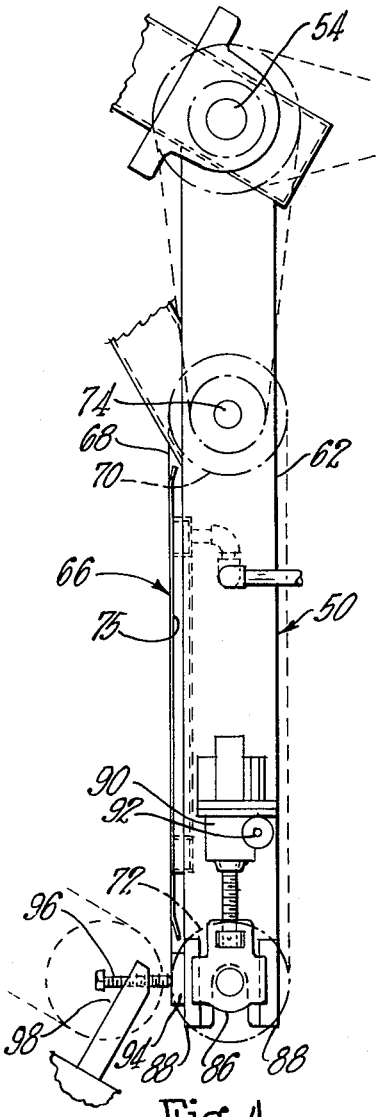
FIG. 4 is a side view in elevation of the back-up conveyor of FIG. 3, and further showing part of a supporting frame thereof.
Figure 3:
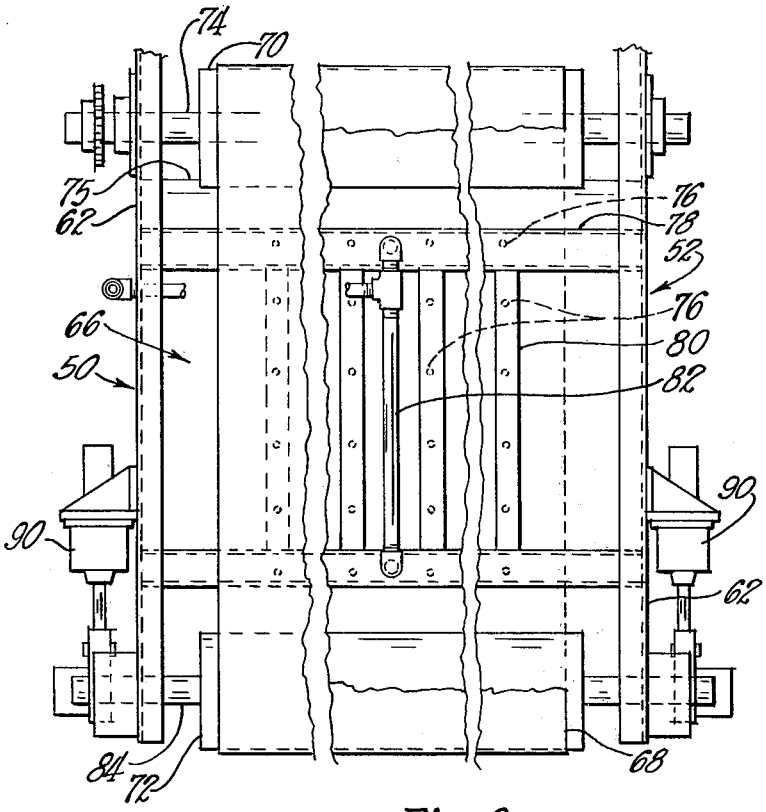
FIG. 3 is an enlarged, fragmentary rear view, with parts broken away, of a back-up conveyor of the apparatus of FIGS. 1 and 2.

The packaging apparatus 22 has a main framework generally indicated at 46 which carries a back-up conveyor assembly indicated at 48. Referring to FIGS. 1–4, the back-up assembly 48 includes two main side frame members 50 and 52 which are pivotally supported at intermediate portions on a combination pivot and drive shaft 54 extending across the framework 46. Each of the frames 50 and 52 has a forwardly-extending portion 56 having ends joined by a crossbar 58 to which a pneumatic cylinder 60 is pivotally connected. Counterweights are also preferably positioned on the crossbar 58. Each of the frame members 50 and 52 also has a rear downwardly-extending portion 62 below the pivot shaft 54. Referring to FIGS. 3 and 4, a generally upright back-up conveyor 66 or movable means is carried by the frame portions 62 of the frame members and includes a belt 68, a head pulley 70, and a tail pulley 72, the head pulley being mounted on a drive shaft 74 which is driven from the combination pivot and drive shaft 54. A forward run of the belt 68 is driven in a direction away from the path of the strip to correspondingly move the forward edge of the strip. The belt 68 of the conveyor 66 is backed up by a skid plate 75 having perforations 76 through which horizontal manifolds 78 and vertical manifolds 89 blow air under pressure. The air can be supplied through suitable supply pipes 82 from the usual shop air source, and regulated to a pressure of 15 psi, by way of example. This air minimizes friction between the conveyor belt 68 and the skid plate 75 particularly as the package is being wound and pressure is applied thereto through the belt 68.

Since the belt 68 tends to stretch, the lower or tail pulley 72 is mounted on a shaft 84 which is rotatably supported in bearing blocks 86 (FIG. 4); these are slidably mounted on guides 88. The blocks can be moved longitudinally by commercially-available worm gear jacks 90 which are tied together by a common adjusting shaft 92 so that they can be adjusted equally to move the bearing blocks 86 equal amounts.

The conveyor 66 further has stops 94 at each edge adjacent the guides 88. The stops 94 abut ends of adjustable screws 96 carried by suitable brackets 98 to determine the lower position of the conveyor 66 when fluid is supplied to the rod end of the fluid-operated cylinder 60.

Figure 5:
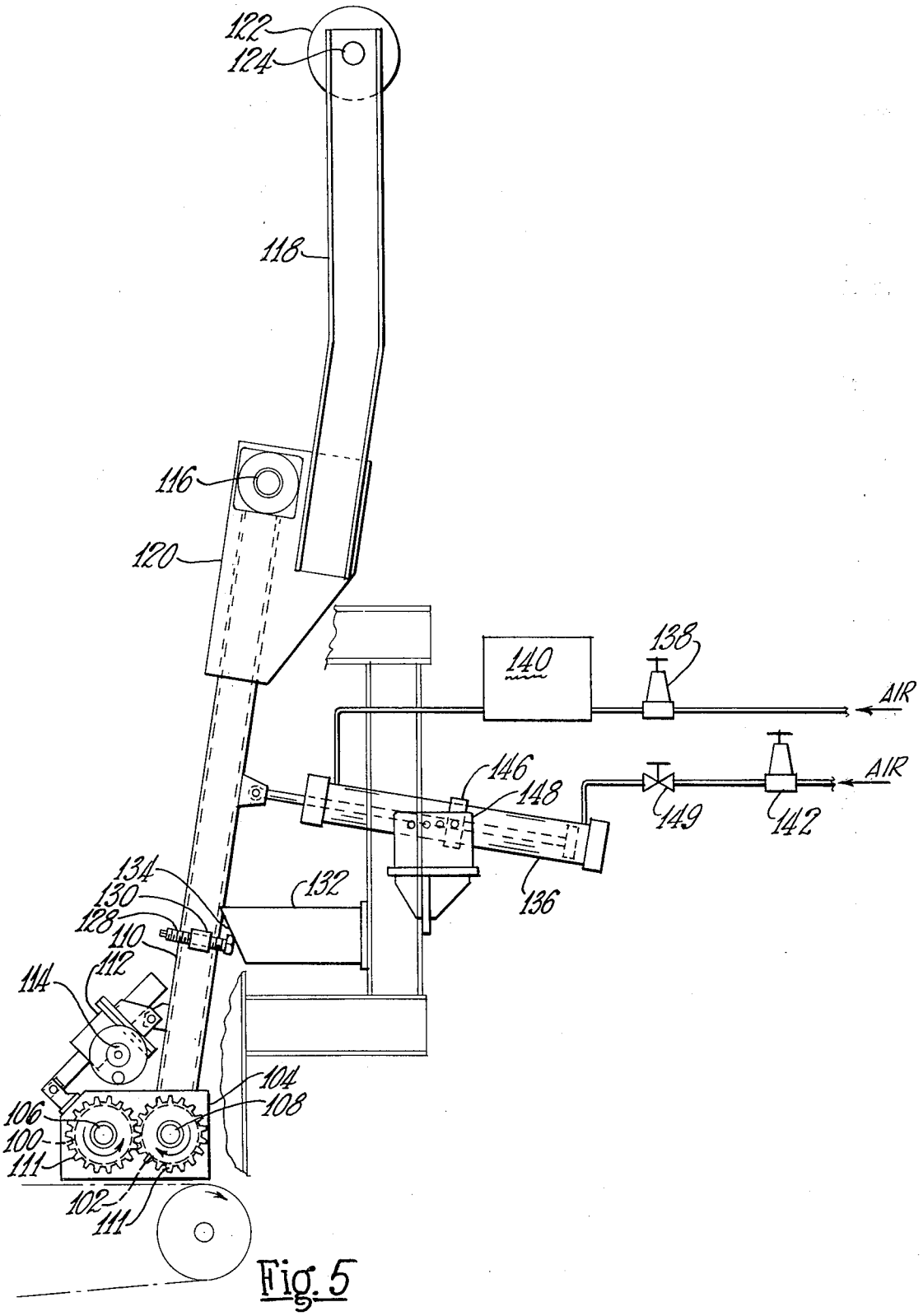
FIG. 5 is a somewhat schematic side view in elevation, with parts broken away, of guide and tuck rolls of the packaging apparatus and their supporting frame.

Referring particularly to FIG. 5, a first infeed or guide roll 100 is positioned forwardly or upstream of a second compression or tuck roll 102. These are rotatably carried by side frame plates 104 which hold the rolls in spaced relationship. The roll 100 is mounted on a first shaft 106 carried by the side plates 104 and the roll 102 is mounted on a shaft 108 which extends through the side plates 104 and is rotatably carried by side frame beams 110. The shafts 106 and 108 geared together by gears 111 so that the rolls 100 and 102 rotate at equal speeds but in opposite directions, the infeed roll 100 rotating in a counterclockwise direction and the compression roll 102 rotating in a clockwise direction, as viewed in FIG. 5.

Worm gear jacks 112, similar to the jacks 90, are pivotally connected between outer portions of the side plates 104 and portions of the side beams 110 spaced above the shaft 108. These jacks also can be connected by a common shaft 114 so as to be equally turned and thereby pivot the side plates 104 equally around the shaft 108. This enables the infeed roll 100 to be adjusted up or down relative to the compression roll 102. In a preferred form, the infeed roll 100 is slightly below the roll 102 to press the forward edge of the fibrous strip downwardly and move it below the compression roll 102, thereby substantially eliminating the possibility of the forward edge of the strip being forced up between the rolls 100 and 102 by the counter rotation of the roll 102. This rotation of the tuck roll 102 is important since it engages the forward edge of the fibrous strip after it is moved upwardly by the belt 66 and causes the forward edge to turn back on itself and move downwardly to start the core of the spiral package of strip. This will be discussed more fully subsequently.

The frame beams 110 are pivotally supported on an upper pivot shaft 116 which is carried by the main framework 46. Extension beams 118 are connected to the side beams 110 through structural plates 120 and terminate at their upper ends in counterweights 122 on a transverse rod 124 (FIG. 2 also). The counterweights eliminate excess compression of the strip being packaged, which would otherwise result from the heavy weight of the roll assembly. Greater sensitivity in movement and pressure of the assembly is also achieved.

Referring to FIG. 1, the pivot shaft 116 for the rolls 100 and 102 is rotatably mounted in bearing blocks 124 which are mounted for vertical movement by the framework. The bearing blocks 124 can be vertically adjusted by worm gear jacks 126 or the like, thereby moving the entire assembly, including the rolls 100 and 102 vertically, toward and away from the horizontal portion 36 of the conveyor 32. This enables the rolls to be adjustable for a wide variety of thicknesses of the fibrous strip with the uncured wool being available in many thicknesses for different applications. Adjustable stop screws 128 (FIG. 5) are carried by threaded brackets 130 on the side beams 110. The stop screws 128 bear against stop brackets 132 having sloping faces 134 against which the stop screws ride as the frame beams 110 are adjusted vertically. The sloping faces are parallel to the conveyor 66 and automatically maintain the compression roll 102 at a constant distance from the back-up conveyor belt 68 regardless of the vertical position of the rolls 100 and 102.

The compression roll 102 is urged against the fibrous strip being wound at all times in order to maintain the package under compression. For this purpose, fluid-operated cylinders 136 are pivotally connected to intermediate portions of the side frame beams 110. Air under a fixed pressure determined by a regulator 138 is supplied through an accumulator 140 to the rod end of each cylinder. A given compressive force is thus established on the package of fibrous strip by the compression roll 102. As the package builds up, the rolls 102 move outwardly, overcoming the air pressure. This forces the air back into the accumulator 140 with the result that the air pressure increases somewhat in the rod end of the cylinder as the roll 102 moves outwardly so that an increased compressive force is achieved as the size of the package increases. The amount of increase in pressure depends on the relative sizes of the cylinder 136 and the accumulator 140. By way of example, air supplied to the rod end of the cylinder can be at a pressure of 10 psi, with this pressure increasing to 11 psi as the package is wound to its maximum diameter, the pressure increase being about 10 percent.

Air under a higher pressure regulated by a regulator 142 can be supplied to the blind end of the cylinder 136, and controlled by a valve 144. This air is under a much higher pressure to overcome the pressure at the rod end of the cylinder and to immediately swing open the frame beams 110 and rolls when the valve 144 is opened to abort a packaging cycle in the case of a mishap, jamming, etc.

The cylinder 136 has a central mounting collar 146 which is adjustably mounted in brackets 148 so that the cylinder can be adjusted to accommodate various initial positions of the frame beams 110.

Figure 6:
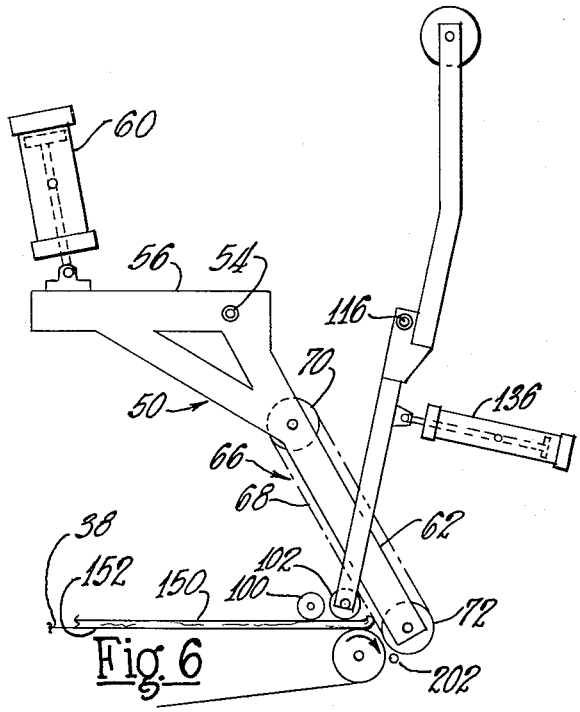
FIG. 6 is a schematic side view in elevation of the packaging apparatus and showing components thereof in a position to receive a strip.
Figure 7:
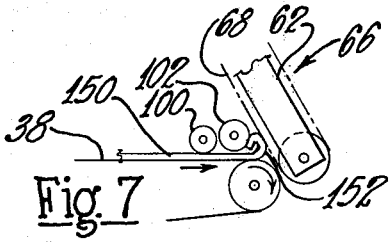
FIG. 7 is a schematic, enlarged, fragmentary side view of components of FIG. 6 rolling a forward edge of the strip into a core.

The operation of the main or basic components of the packaging machine will now be described in connection with FIGS. 6-9. A fibrous strip 150, including a backing sheet 152, is carried along the belt 38 on the horizontal portion 36 of the conveyor 32. The forward edge of the strip is engaged by the infeed roll 100 to provide further positive forward feed and to move the forward edge of the strip under the compression roll 102. This prevents the possibility of the forward edge of the strip meeting resistance from the roll 102, which rotates in the opposite direction, and possibly forcing the strip between the rolls 100 and 102 or otherwise causing it to buckle. After the forward edge of the strip 150 moves under the roll 102, it engages a transverse surface formed by the upwardly moving forward run of the belt 68 and is carried upwardly thereby, as shown in FIG. 6. When the forward edge engages the compression roll 102, which is positioned close to the belt 68, it is then tucked back or turned downwardly by the counter movement of that roll (FIG. 7). This action causes the strip to thereby start to roll on itself and begin the core of the package.

Figure 8:
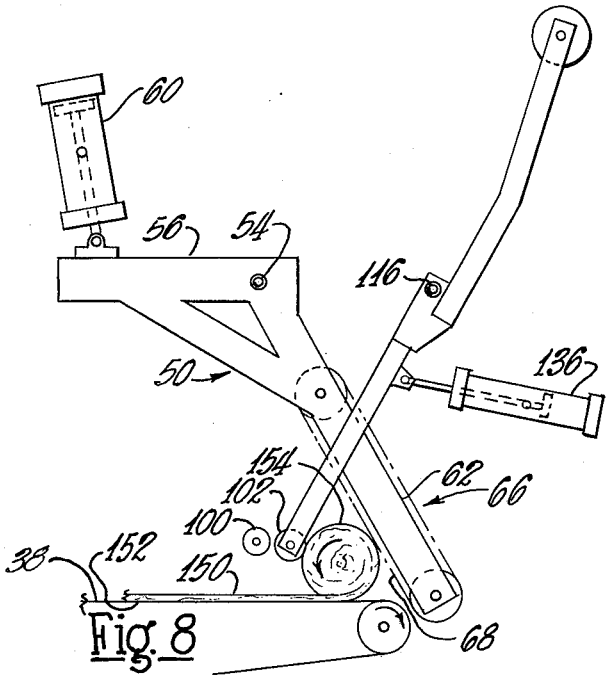
FIGS. 8 and 9 are schematic side views similar to FIG. 6 and showing the components in different positions during the packaging and discharging of a fibrous strip.

The strip 150 continues to be engaged by the upwardly moving run of the belt 62 and by the compression roll 102 which now moves outwardly with the outer surface of a package 154 being formed (FIG. 8). As the package increases in size, the compression roll 102 is forced outwardly as the air pressure in the rod ends of the cylinders 136 is overcome, but with the compression roll 102 maintaining a compressive force on the package due to the air pressure. With the accumulator, the air pressure increases somewhat as the package size increases so that the compressive force of the roll 102 on the package increases as the package diameter increases.

Figure 9:
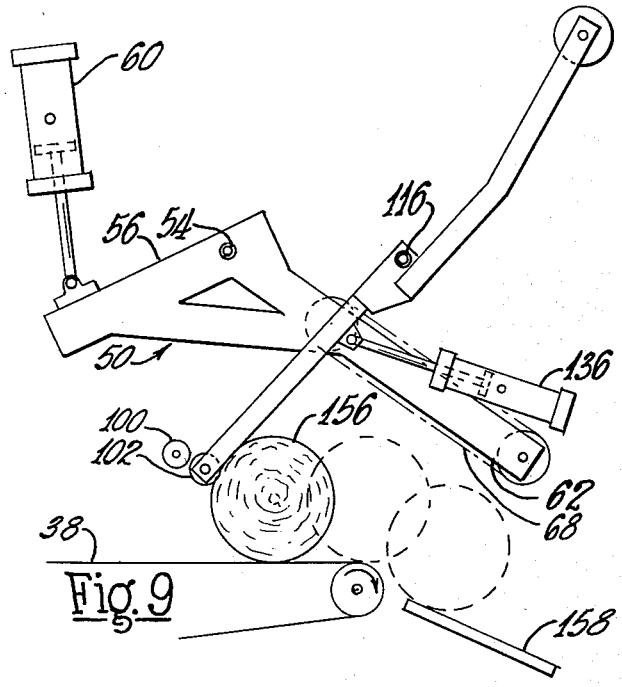

When a finished package results, as indicated at 156 in FIG. 9, it preferably is rotated through one or two additional revolutions, as will be discussed subsequently. By means of a timer, the cylinder 60 is then actuated to move the back-up assembly 66 away from the horizontal portion 36 of the conveyor 32. The package is then moved as indicated by the dotted lines to a discharge ramp 158. This movement is effected by a combination of the forward movement of the belt 38 of the conveyor 32 and by the compression roll 102 which moves quickly back to its original position automatically because of the air pressure in the rod ends of the cylinders 136. This movement continues until the adjustable stops 128 (FIG. 5) once again engage the sloping surfaces 134 of the stop brackets 132. When air pressure is applied to the rod end of the cylinder 60, the back-up conveyor 56 moves back against the adjustable stops 96 (FIG. 4) and the machine is ready for another cycle. The next cycle is initiated when another fibrous strip moves onto the transfer conveyor 24 and interrupts and electric eye (not shown) which begins the operation of the timer which operates the back-up assembly 48.

Tapes are applied around the packaged strip before being discharged to maintain it in the packaged, compressed condition. The number of tapes employed will depend upon the width of the fibrous strip being packaged. Further, if two or more fibrous strips are employed in side-by-side relationship and packaged simultaneously, at least one tape will be needed for each of those strips. However, by way of illustration, with a six-foot wide strip, three tapes are suitable to maintain the strip in the packaged form. To supply the three tapes, two banks 160 of three tape dispensing devices or machines 162 are employed below the transfer conveyor 24. The tape dispensing devices 162 can be of a modified commercially-available design as shown in Miller et al U.S. application Ser. No. 432,236, filed Nov. 2, 1973, and will not be discussed in further detail. Assuming the lower bank of dispensing devices is in operation, a vacuum conveyor 164, having a perforate belt 166 driven through a tail pulley 168 which is pivotally mounted relative to the banks of the tape dispensing devices, is lowered by a fluid-operated cylinder 170 to received tapes from the lower bank. A vacuum is established below the perforate belt 166 by a suitable blower 172 connected by a flexible duct 174. The transfer conveyor 164 feeds the tape to the slanted portion 34 of the conveyor 32 where the tapes are carried up and into contact with the fibrous strip 150 and specifically with the backing sheet 152 of the strip, in this instance. The tape has a wetted, adhesive side facing upwardly so as to adhere to the backing sheet when in contact therewith and severed by the tape dispensing devices 162, so as to move along the conveyor. The tape is severed in timed relation with the trailing end of the fibrous strip so that part of the tape will adhere to the backing sheet of the strip but trail behind the trailing end so as to be wrapped on the previous wrap of the strip when carried into the package and engaged by the back-up conveyor 66 and the compression roll 102.

With the particular tape dispensing arrangement, even if the tape is dispensed late so that it is not adhered to the strip but trails entirely behind the trailing end of it, nevertheless, the tape will be carried by the conveyor 32 into the packaging machine and wound around the package to hold the package in the compressed condition. This is the reason the finished package is given one or two additional revolutions prior to being discharged. The tape preferably has a length exceeding the circumference of the finished package so as to be sure to adhere the trailing end of the compressed fibrous strip to the previous wrap.

Figure 11:
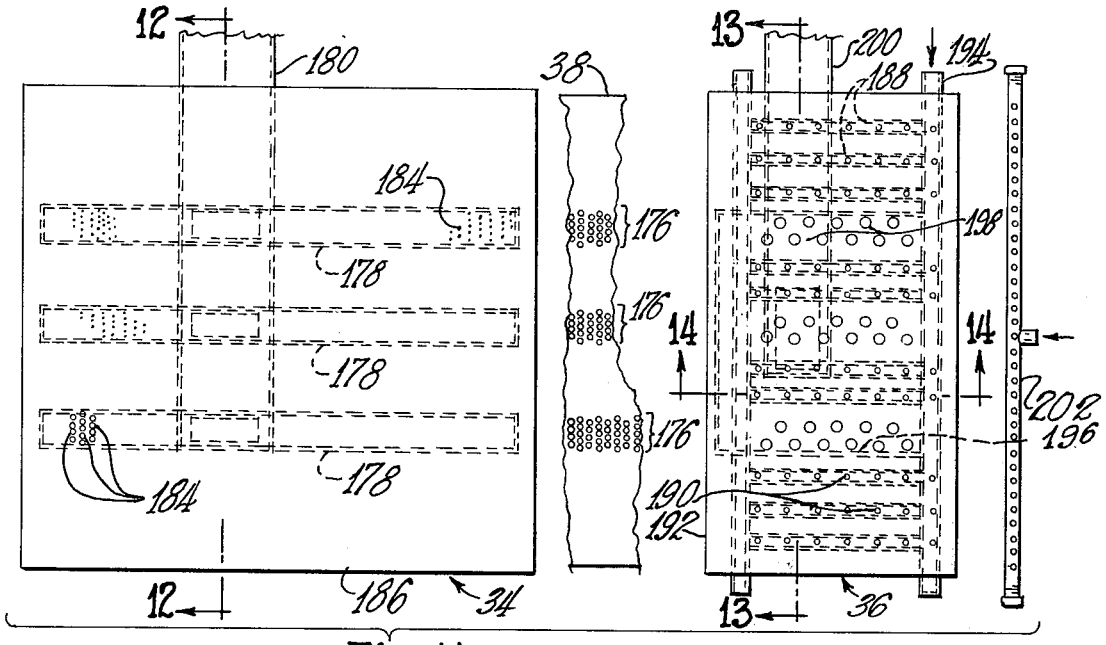
FIG. 11 is a schematic plan view of the apparatus of FIG. 10 and further showing part of a conveyor belt.

In order for the tapes to be carried along the conveyor in the event they are not adhered to the strip, and also for the purpose of maintaining the tapes in position on the conveyor even when adhered to the strip, the conveyor 32 has vacuum provisions as shown in FIGS. 10–14. Referring to FIG. 11, the belt 38 has three rows 176 of perforations for the three tapes. Three vacuum chambers 178 extend longitudinally of the belt 38 and communicate with the rows 176 of perforations. A vacuum manifold 180 communicates with the three elongate chambers and is connected to a vacuum blower 182 (FIG. 2). The elongate chambers 178 communicate with the rows 176 of perforations through perforations 184 in a skid plate 186 of the slanted conveyor portion 34 to establish elongate negative pressure zones along the rows 176 of perforations in the belt 38.

Air under pressure is supplied below certain portions of the belt 38 at the horizontal conveyor portion 36 to minimize friction, particularly during the packaging of the fibrous strip. In this instance, a plurality of branch manifolds 188 supply air under pressure to perforations 190 in a skid plate 192 to provide air under pressure between the belt and the skid plate. The branch manifolds 188 are positioned under those portions of the belt 38 which do not have the perforate rows 176. The branch manifolds 188 communicate with a main manifold 194 which can be connected to a conventional shop air supply. A vacuum chamber 196 is located below portions of the skid plate 192 corresponding to the perforate rows 176 and have perforations 198 thereabove. The manifold chamber 196 is connected by a suitable vacuum line 200 to the vacuum blower 182. With this arrangement, friction of the belt 38 on the skid plate 192 of the conveyor 32 is held to a minimum, yet at the same time, the tapes are positively fed along the perforate rows 176 from the transfer conveyor 166 into the packaging machine to be assured of being applied to the package and holding the compressed fibrous strip in its packaged form for further handling and processing.

Figure 10:
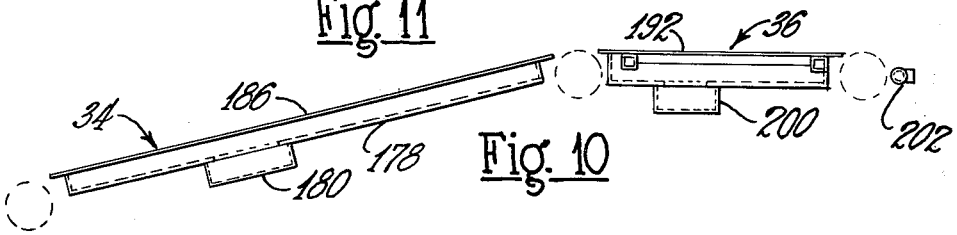
FIG. 10 is a schematic side view in elevation of components of a conveyor which feeds the fibrous strip into the packaging machine, and a pneumatic header at the end of the conveyor.
Figure 12:
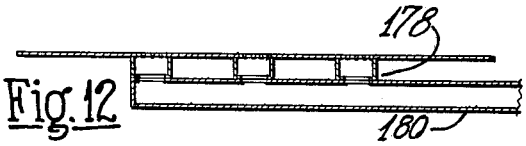
FIGS. 12–14 are schematic views in cross section taken along the corresponding lines of FIG. 11.
Figure 13:
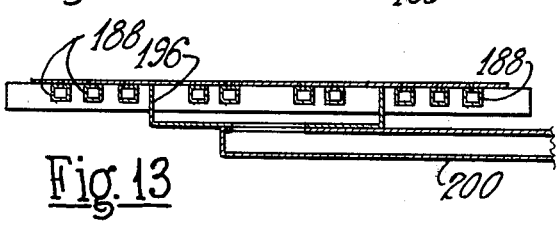
Figure 14:
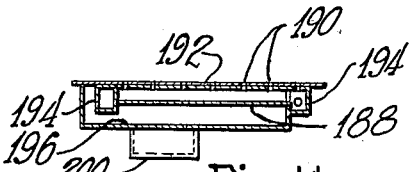

As shown in FIGS. 6, 10, and 11, a header 202 can be used to blow air up along the forward run of the back-up conveyor belt 68. This aids in directing the forward edge of the strip 150 upwardly from its generally horizontal path. The header 202 is by no means essential, however.

Referring to FIG. 1, most of the components of the packaging machine are driven by a single drive unit 204 through various sprockets and chains which will not be described in detail. The unit 204 drives the back-up conveyor 66, the rolls 100 and 102, the conveyor 32, and the transfer conveyor 24. Only the vacuum blowers 172 and 182 are driven separately, along with the tape dispensing units 162.

Various modifications of the above-described embodiment of the invention will be apparent to those skilled in the art and it is to be understood that such modifications can be made without departing from the scope of the invention, if they are within the spirit and the tenor of the accompanying claims.

We claim;

1. A method of packaging a fibrous strip into a roll, said method comprising feeding the strip longitudinally along a path, positioning a surface with a portion extending into the path, moving the surface transversely of the path to cause the forward edge of the strip to be moved transversely away from the path, positioning a roll near the surface on the side from which the strip is fed, engaging the forward edge of the strip with the roll, rotating the roll with a portion nearest the surface moving in a direction opposite to the surface to move the forward edge of the strip back toward the feeding path, applying compressive forces to the outer wrap of the strip as it is being rolled, and increasing the compressive forces as the size of the rolled strip increases.

2. A method according to claim 1 characterized by continuing to rotate the packaged strip after it is rolled, and applying a tape around the outer wrap of the packaged strip.

3. Apparatus for rolling and compressing a flexible, compressible, fibrous strip, said apparatus comprising means for feeding the strip longitudinally along a path, a belt conveyor positioned transversely to the path and having a portion extending into the path, said belt conveyor having a back-up plate and means establishing air under positive pressure between the belt and said plate, said conveyor being effective to engage a forward edge of the strip and move it transversely to the path, and means positioned near said conveyor and engagable with the forward edge of the strip as it moves transversely to the path to direct the forward edge back in the opposite direction to form a core for the strip as it is being rolled.

4. Apparatus according to claim 3 characterized by said belt conveyor having a tail pulley constituting the portion extending into the path of the strip.

5. Apparatus according to claim 3 characterized by means for moving the belt with a forward run thereof engagable with the forward edge of the strip being moved in a direction away from the path.

6. Apparatus for packaging a fibrous strip into a roll, said apparatus comprising a conveyor for feeding the strip longitudinally along a path, movable means having a surface positioned transversely of the path with a portion thereof extending into the path, means for moving the surface transversely of the path to cause a forward edge of said strip to be moved transversely away from the path, a compression roll positioned near said movable means on the side from which the strip is fed and engagable with the forward edge of the strip as it moves away from the path, means for driving said roll with a portion nearest said movable means moving in a direction opposite to the surface to cause said roll to move the forward edge of the strip back toward said path, fluid-operated, yieldable means urging said compression roll toward said movable means, and a guide roll upstream of said compression roll for guiding the forward edge of the strip under said compression roll as the strip moves toward said movable means.

7. Apparatus according to claim 6 characterized by means for driving said guide roll in a direction opposite to that of said compression roll.

8. Apparatus for packaging a fibrous strip into a roll, said apparatus comprising a conveyor for feeding the strip longitudinally along a path, movable means having a surface positioned transversely of the path with a portion thereof extending into the path, means for moving the surface transversely of the path to cause a forward edge of said strip to be moved transversely away from the path, a compression roll positioned near said movable means on the side from which the strip is fed and engagable with the forward edge of the strip as it moves away from the path, means for driving said roll with a portion nearest said movable means moving in a direction opposite the surface to cause said roll to move the forward edge of the strip back toward said path, and a pneumatically-operated cylinder urging said compression roll toward said movable means.

9. Apparatus according to claim 8 characterized by means including an accumulator for supplying air under pressure to said pneumatically-operated cylinder.

10. Apparatus for packaging a fibrous strip into a roll, said apparatus comprising a conveyor for feeding the strip longitudinally along a path, movable means having a surface positioned transversely of the path with a portion thereof extending into the path, means for moving the surface transversely of the path to cause a forward edge of said strip to be moved transversely away from the path, a compression roll, a pivoted frame rotatably carrying said compression roll and positioning said compression roll near said movable means on the side from which the strip is fed to enable said compression roll to engage the forward edge of the strip as it moves away from the path, means for driving said roll with a portion nearest said movable means moving in a direction opposite to the surface to cause said roll to move the forward edge of the strip back toward said path, and a pneumatically-operated cylinder having a piston rod connected to said frame at a position spaced from the pivot thereof to urge said compression roll toward said movable means.

11. Apparatus according to claim 10 characterized by means including an accumulator for supplying air under pressure to said cylinder for urging said frame and said roll toward said movable means.

12. Apparatus for packaging a fibrous strip into a roll, said apparatus comprising packaging means for receiving a forward edge of the strip and for rolling the strip spirally into the roll, means for feeding the strip longitudinally along the path toward said packaging means, said feeding means comprising a belt conveyor having a plurality of parallel groups of perforations extending longitudinally thereof, suction means under the perforate portions of the belt for pulling air through the perforations, and means for supplying air under positive pressure to portions of the belt which are not perforated, and means for dispensing tape onto the perforate portions of said belt.

13. Apparatus according to claim 12 characterized by said packaging means comprises an upright belt conveyor having a forward run extending into the path of the strip, said upright conveyor having a back-up plate, and means for supplying air under positive pressure between the forward run of the belt and said back-up plate.

14. Apparatus according to claim 13 characterized further by said packaging means comprises a compression roll positioned adjacent the forward end of the upright belt to receive the forward edge of the strip when moved away from the path by the forward run of the upright conveyor belt.

15. Apparatus according to claim 14 characterized further by a guide roll positioned upstream of said compression roll to receive the forward edge of the strip and move it under said compression roll.

16. Apparatus for rolling and compressing a flexible, compressible, fibrous strip, said apparatus comprising means for feeding the strip longitudinally along a path, movable means positioned transversely to the path and having a portion extending into the path, said movable means being effective to engage a forward edge of the strip and move it transversely to the path, a compression roll positioned near said movable means and engagable with the forward edge of the strip as it moves transversely to the path to direct the forward edge back in the opposite direction to form a core for the strip as it is being rolled, means for driving said roll with the surface near said movable means movable in a direction opposite to that of said movable means, a guide roll upstream of said compression roll for guiding the forward edge of said strip under said compression roll, and means for driving said guide roll in a direction opposite to that of said compression roll.

17. Apparatus for rolling and compressing a flexible, compressible, fibrous strip, said apparatus comprising means for feeding the strip longitudinally along a path, movable means positioned transversely to the path and having a portion extending into the path, said movable means being effective to engage a forward edge of the strip and move it transversely to the path, means positioned near said movable means and engagable with the forward edge of the strip as it moves transversely to the path to direct the forward edge back in the opposite direction to form a core for the strip as it is being rolled, tape-dispensing means for dispensing tape longitudinally of said feeding means between said feeding means and said fibrous strip with an adhesive side facing upwardly for engaging the lower surface of the fibrous strip, suction means for applying suction to the tape on said feeding means to aid in maintaining the tape on said feeding means, and positive pressure means for supplying air under pressure to portions of said feeding means which are not under suction.

18. Apparatus for rolling and compressing a flexible, compressible, fibrous strip, said apparatus comprising means for feeding the strip longitudinally along a path, movable means positioned transversely to the path and having a portion extending into the path, said movable means being effective to engage a forward edge of the strip and move it transversely to the path, means positioned near said movable means and engagable with the forward edge of the strip as it moves transversely to the path to direct the forward edge back in the opposite direction to form a core for the strip as it is being rolled, and a fluid-operated cylinder for urging said last-named means towards said movable means.

19. Apparatus for rolling and compressing a flexible, compressible, fibrous strip, said apparatus comprising means for feeding the strip longitudinally along a path, movable means including an elongate belt positioned transversely to the path and having a portion extending into the path, said movable means being effective to engage a forward edge of the strip and move it transversely to the path, a pivoted frame rotatably carrying said movable means for movement away from said feeding means, means positioned near said movable means and engagable with the forward edge of the strip as it moves transversely to the path to direct the forward edge back in the opposite direction to form a core for the strip as it is being rolled, and means for moving said pivoted frame in a direction to move said belt up and away from said feeding means to enable a rolled and compressed strip to be discharged between said feeding means and said belt.

20. Apparatus for rolling and compressing a flexible, compressible, fibrous strip, said apparatus comprising means for feeding the strip longitudinally along a path, movable means positioned transversely to the path and having a portion extending into the path, said movable means being effective to engage a forward edge of the strip and move it transversely to the path, means positioned near said movable means and engagable with the forward edge of the strip as it moves transversely to the path to direct the forward edge back in the opposite direction to form a core for the strip as it is being rolled, a pivoted frame rotatably carrying said last-named means, and a fluid-operated cylinder connected with said frame for urging said last-named means towards said movable means.

21. Apparatus for packaging a fibrous strip into a roll, said apparatus comprising a conveyor for feeding the strip longitudinally along a path, a belt conveyor having a surface positioned transversely of the path with a portion thereof extending into the path, said belt conveyor having a back-up plate and means for supplying air under positive pressure between the plate and said surface, means for moving the surface transversely of the path to cause a forward edge of said strip to be moved transversely away from the path, a compression roll positioned near said movable means on the side from which the strip is fed and engagable with the forward edge of the strip as it moves away from the path, means for driving said roll with a portion nearest said movable means moving in a direction opposite the surface to cause said roll to move the forward edge of the strip back toward said path, and yieldable means urging said compression roll toward said movable means.

22. Apparatus for packaging a fibrous strip into a roll, said apparatus comprising a conveyor for feeding the strip longitudinally along a path, movable means having a surface positioned transversely of the path with a portion thereof extending into the path, means for moving the surface transversely of the path to cause a forward edge of said strip to be moved transversely away from the path, a compression roll positioned near said movable means on the side from which the strip is fed and engagable with the forward edge of the strip as it moves away from the path, means for driving said roll with a portion nearest said movable means moving in a direction opposite the surface to cause said roll to move the forward edge of the strip back toward said path, yieldable means urging said compression roll toward said movable means, tape-dispensing means for dispensing tape longitudinally of said conveyor between said conveyor and said fibrous strip with an adhesive side facing upwardly for engaging the lower surface of the fibrous strip, suction means for applying suction to the tape on said conveyor for maintaining the tape on said conveyor, and positive pressure means for supplying air under pressure to portions of said conveyor which are not under suction.

23. Apparatus for packaging a fibrous strip into a roll, said apparatus comprising a conveyor for feeding the strip longitudinally along a path, movable means having a surface positioned transversely of the path with a portion thereof extending into the path, means for moving the surface transversely of the path to cause a forward edge of said strip to be moved transversely away from the path, a compression roll, a pivoted frame rotatably carrying said compression roll and positioning said compression roll near said movable means on the side from which the strip is fed to enable said compression roll to engage the forward edge of the strip as it moves away from the path, said frame being pivoted about a fixed axis as the roll of the fibrous strip increases in diameter, means for moving the pivot of said frame toward and away from said conveyor to initially accommodate fibrous strips of different thicknesses, means for driving said compression roll with a portion near said movable means moving in a direction opposite the surface to cause said compression roll to move the forward edge of the strip back towards said path, and yieldable means urging said frame and said compression roll toward said movable means.

24. Apparatus according to claim 23 characterized by guide means located upstream of said compression roll for guiding the forward edge of the strip under said compression roll as the strip moves towards said movable means; said guide means also being carried by said pivoted frame.

25. Apparatus according to claim 24 characterized by means for moving said guide means toward and away from said feeding conveyor independently of said compression roll.

* * * * *